US011724503B2

(12) United States Patent
Watanabe

(10) Patent No.: US 11,724,503 B2
(45) Date of Patent: Aug. 15, 2023

(54) LIQUID EJECTING APPARATUS AND MAINTENANCE METHOD OF LIQUID EJECTING APPARATUS

(71) Applicant: Seiko Epson Corporation, Tokyo (JP)

(72) Inventor: Midori Watanabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/488,571

(22) Filed: Sep. 29, 2021

(65) Prior Publication Data

US 2022/0097378 A1 Mar. 31, 2022

(30) Foreign Application Priority Data

Sep. 30, 2020 (JP) ..... JP2020-165282

(51) Int. Cl.
*B41J 2/165* (2006.01)

(52) U.S. Cl.
CPC ..... *B41J 2/16505* (2013.01); *B41J 2/1652* (2013.01)

(58) Field of Classification Search
CPC ..... B41J 2/16505; B41J 2/1652
See application file for complete search history.

(56) References Cited

U.S. PATENT DOCUMENTS

2007/0257956 A1 11/2007 Akase et al.
2019/0100012 A1* 4/2019 Iida ..... B41J 2/16517

FOREIGN PATENT DOCUMENTS

JP 2008-044337 2/2008

* cited by examiner

*Primary Examiner* — Sharon Polk
(74) *Attorney, Agent, or Firm* — Workman Nydegger

(57) ABSTRACT

A liquid ejecting apparatus includes an ejecting head that ejects a liquid containing a humectant and water from a nozzle, a cap configured to form a closed space to which the nozzle opens, and a controller that controls the ejecting head, wherein the controller includes a calculation unit and a discharge controller, wherein the calculation unit calculates an available water amount of the liquid in the cap, and when the available water amount is smaller than a preset initial available water amount, the discharge controller discharges an amount of the liquid, where the amount includes, as the available water amount, an amount obtained by multiplying a difference between the available water amount and the initial available water amount by a predetermined coefficient larger than one.

7 Claims, 6 Drawing Sheets

FIG. 6

| | | EVAPORATION AMOUNT (g) | | | | |
|---|---|---|---|---|---|---|
| | | 0 | 0.1 | 0.2 | 0.5 | 1.3 |
| COEFFICIENT | 0 | Good | Poor | Poor | Poor | Poor |
| | 1 | Good | Poor | Poor | Poor | Poor |
| | 2 | Good | Good | Good | Good | Poor |
| | 2.5 | Good | Good | Good | Good | Good |

LIQUID EJECTING APPARATUS AND MAINTENANCE METHOD OF LIQUID EJECTING APPARATUS

The present application is based on, and claims priority from JP Application Serial Number 2020-165282, filed Sep. 30, 2020, the disclosure of which is hereby incorporated by reference herein in its entirety.

BACKGROUND

1. Technical Field

The present disclosure relates to a liquid ejecting apparatus and a maintenance method of the liquid ejecting apparatus.

2. Related Art

For example, as in JP-A-2008-44337, there is a printer which is an example of a liquid ejecting apparatus which ejects ink, which is an example of a liquid, from a recording head, which is an example of a liquid ejecting head, to perform printing. The printer includes a cap that caps the nozzle.

The ink contains a humectant to suppress an increase in viscosity in the nozzle. However, the humectant absorbs the surrounding water when the water in the ink evaporates. Therefore, when the nozzle is capped with a cap to which ink is attached, the humectant deprives the ink in the nozzle of water. In the printer of JP-A-2008-44337, the evaporated water is supplemented with the ink by replenishing the cap with the ink.

The printer of JP-A-2008-44337 replenishes the ink so that the available water amount in the cap, which is obtained by subtracting the water amount absorbed by the humectant from the water amount contained in the liquid, returns to the initial value. However, even when the ink is replenished so that the available water amount in the cap returns to the initial value, the viscosity of the ink in the nozzle may increase more than expected.

SUMMARY

According to an aspect of the present disclosure, a liquid ejecting apparatus includes a liquid ejecting head that ejects a liquid containing a humectant and water from a nozzle, a cap configured to form a closed space to which the nozzle opens, and a controller that controls the liquid ejecting head, wherein the controller includes a calculation unit that calculates an available water amount obtained by subtracting a water amount absorbed by the humectant from a water amount in the liquid, and a discharge controller that forcibly discharges the liquid from the nozzle into the cap, wherein the calculation unit calculates an available water amount in the cap, which is the available water amount of the liquid in the cap, based on an amount of the liquid discharged from the nozzle into the cap, and wherein when the available water amount in the cap is smaller than a preset initial available water amount, the discharge controller discharges the liquid of an amount, where the amount includes, as the available water amount, an amount obtained by multiplying a difference between the available water amount in the cap and the initial available water amount by a predetermined coefficient larger than one.

According to an aspect of the present disclosure, a method of maintaining a liquid ejecting apparatus includes a liquid ejecting head that ejects a liquid containing a humectant and water from a nozzle, and a cap configured to form a closed space to which the nozzle opens, and the method includes calculating an available water amount in the cap obtained by subtracting a water amount absorbed by the humectant from a water amount in the liquid in the cap based on an amount of the liquid discharged from the nozzle into the cap, and when the available water amount in the cap is smaller than a preset initial available water amount, forcibly discharging, from the nozzle into the cap, the liquid of an amount, where the amount includes, as an available water amount obtained by subtracting an amount of water absorbed by the humectant from a water amount in the liquid, an amount obtained by multiplying a difference between the available water amount in the cap and the initial available water amount by a predetermined coefficient larger than one.

BRIEF DESCRIPTION OF THE DRAWINGS

FIG. 6 is a table showing the relationship between the amount of evaporation and the coefficient.

DESCRIPTION OF EXEMPLARY EMBODIMENTS

Figure 1:
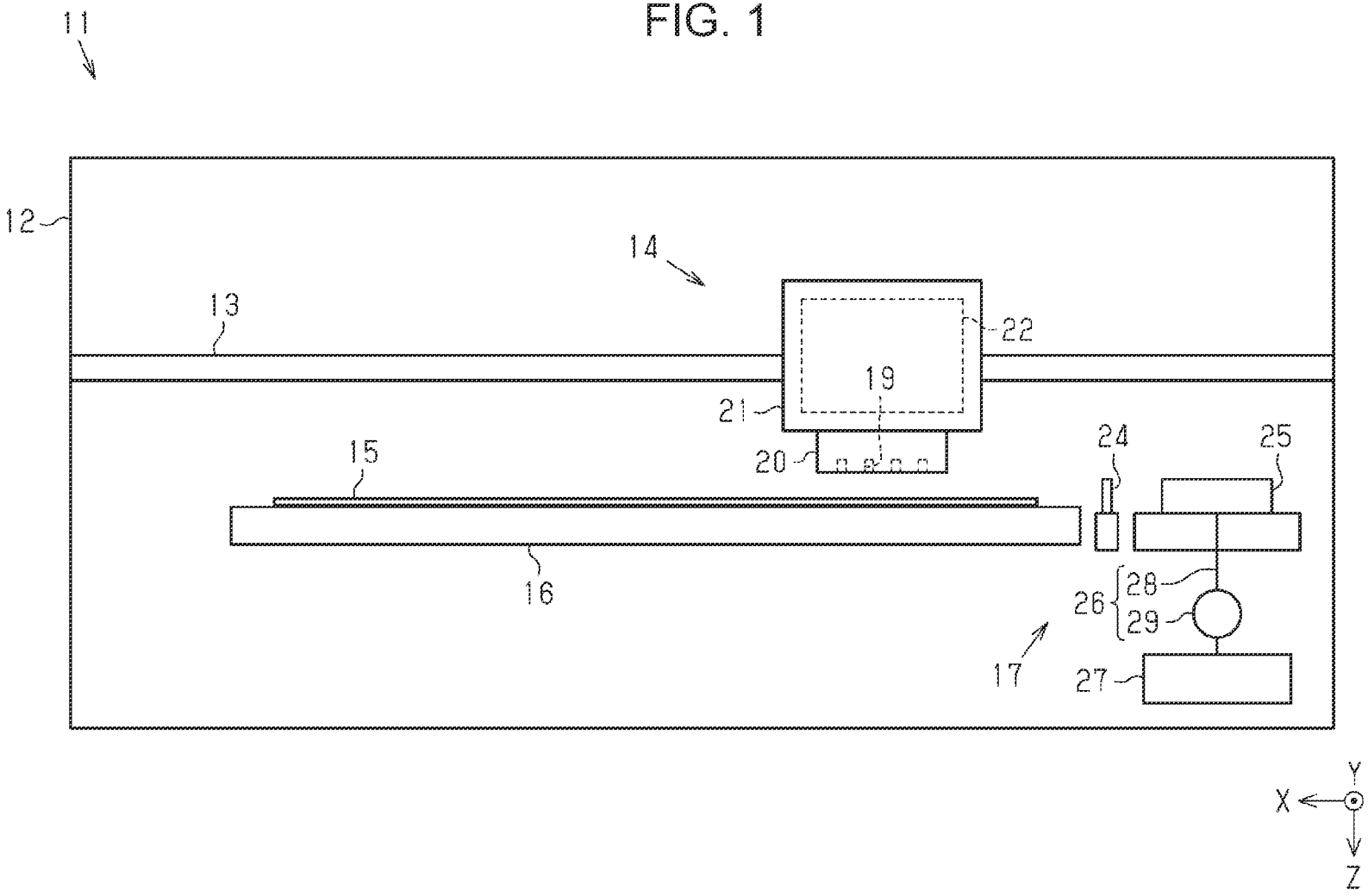
FIG. 1 is a schematic view of an embodiment of a liquid ejecting apparatus.

Hereinafter, an embodiment of a liquid ejecting apparatus and a maintenance method of the liquid ejecting apparatus will be described with reference to the drawings. The liquid ejecting apparatus is, for example, an ink jet printer that ejects ink, which is an example of a liquid, onto a medium such as paper to perform printing.

In the drawings, the direction of gravity is indicated by the Z axis, and the directions along the horizontal plane are indicated by the X axis and the Y axis, assuming that a liquid ejecting apparatus 11 is mounted on the horizontal plane. The X axis, the Y axis, and the Z axis are orthogonal to each other. In the present embodiment, an increasing in viscosity of the liquid is also referred to as thickening.

As shown in FIG. 1, the liquid ejecting apparatus 11 may include a housing 12, a guide shaft 13 supported by the housing 12, and a printing unit 14 movably provided along the guide shaft 13. The liquid ejecting apparatus 11 may include a medium support unit 16 that supports a medium 15 and a maintenance unit 17 that performs maintenance on the printing unit 14.

The printing unit 14 includes a liquid ejecting head 20 that performs printing by ejecting a liquid from a nozzle 19 onto the medium 15. The printing unit 14 may include a carriage 21 that moves the liquid ejecting head 20 along the guide shaft 13. The carriage 21 may move with a liquid container 22 that contains the liquid mounted on the carriage 21. The liquid ejecting head 20 ejects the liquid contained in the liquid container 22.

The maintenance unit 17 may include a wiping unit 24, a cap 25, a suction mechanism 26, and a waste liquid storage unit 27. The suction mechanism 26 may include a discharge path 28 coupling the cap 25 and the waste liquid storage unit 27, and a discharge pump 29 provided in the middle of the discharge path 28.

Figure 2:
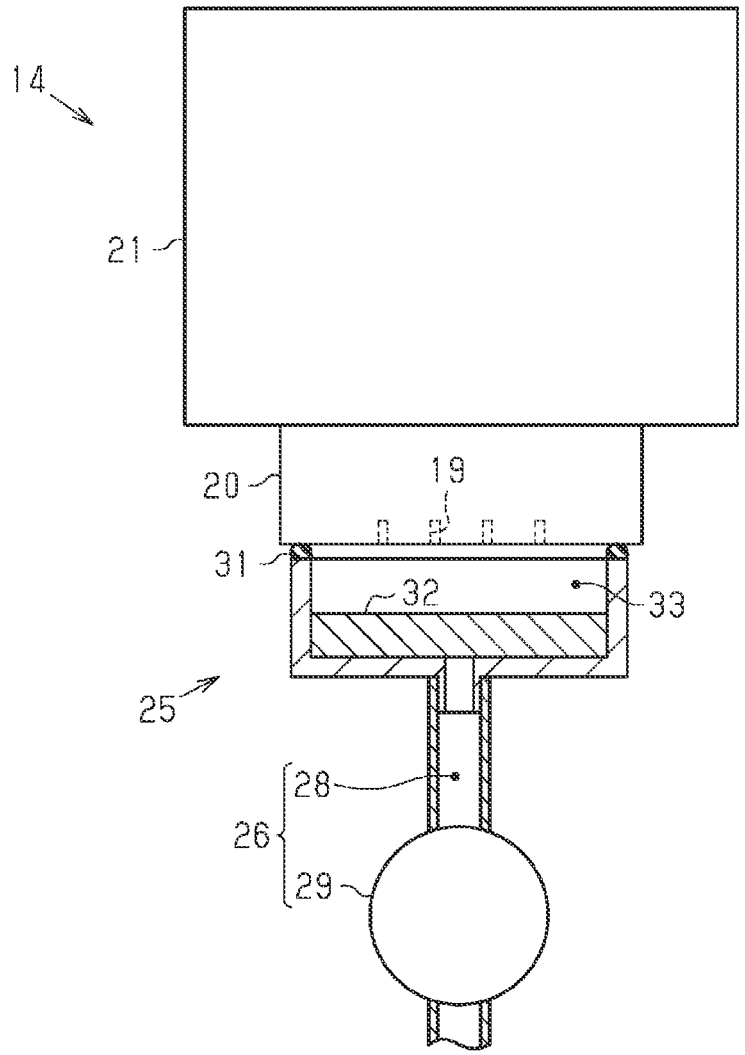
FIG. 2 is a schematic cross-sectional view of a cap.

The cap 25 is provided so as to be movable between a separation position shown in FIG. 1 and a capping position shown in FIG. 2. The discharge path 28 has an upstream end coupled to the cap 25, and a downstream end coupled to the waste liquid storage unit 27. The discharge path 28 may be composed of a tube that deforms as the cap 25 moves. The waste liquid storage unit 27 stores a liquid, as a waste liquid, discharged from the liquid ejecting head 20.

As shown in FIG. 2, the cap 25 may include a lip portion 31 that can come into contact with the liquid ejecting head 20 and an absorbing member 32 that can absorb the liquid. The cap 25 of the present embodiment forms a closed space 33 to which the nozzle 19 opens between the cap 25 and the liquid ejecting head 20 when the lip portion 31 comes into contact with the liquid ejecting head 20. When the lip portion 31 is formed of, for example, elastically deformable rubber or elastomer, hermeticity of the closed space 33 can be enhanced. The absorbing member 32 is located in the closed space 33 and moisturizes the inside of the closed space 33 with the liquid to be retained.

Liquid

The liquid contains a humectant and water. The liquid may contain a material such as a coloring material. Examples of the humectant may include polyhydric alcohols such as glycerin and diethylene glycol. The humectant has hygroscopicity and retains the absorbed water. The humectant can suppress the thickening of the liquid, and as a result, the clogging of the nozzle 19 can be suppressed.

Of the water contained in the liquid, the water absorbed by the humectant is referred to as unavailable water, and the amount of unavailable water is referred to as unavailable water amount. Of the water contained in the liquid, the water that the humectant does not retain is referred to as available water, and the amount of available water is referred to as an available water amount. The amount of the humectant contained in the liquid is referred to as a humectant amount.

Maintenance

As shown in FIG. 1, the wiping unit 24 is provided so as to be movable between a wiping position where the wiping unit 24 can wipe the liquid ejecting head 20 and a non-wiping position where the wiping unit 24 does not come into contact with the liquid ejecting head 20. The wiping unit 24 located at the wiping position wipes the liquid ejecting head 20 by coming into contact with the moving liquid ejecting head 20. The maintenance in which the wiping unit 24 wipes the liquid ejecting head 20 is also referred to as wiping.

As shown in FIG. 2, maintenance in which the cap 25 forms the closed space 33 with the liquid ejecting head 20 is also referred to as capping. The cap 25 located at the capping position caps the liquid ejecting head 20 located at the home position. The cap 25 opens the closed space 33 by moving from the capping position to a separation position.

The suction mechanism 26 sucks the liquid from the nozzle 19 through the closed space 33. Specifically, the suction mechanism 26 drives the discharge pump 29 to reduce the pressure in the closed space 33 and forcibly discharge the liquid from the nozzle 19. The discharged liquid is stored as waste liquid in the waste liquid storage unit 27 via the discharge path 28. Maintenance in which the inside of the closed space 33 is depressurized and the liquid is forcibly discharged from the nozzle 19 is also referred to as suction cleaning.

The suction mechanism 26 may drive the discharge pump 29 with the cap 25 located at the separation position to discharge the liquid in the cap 25. Maintenance in which the liquid in the cap 25 is forcibly discharged while the closed space 33 is open is also referred to as an empty suction.

The maintenance of discharging the liquid from the nozzle 19 by ejection is also referred to as an empty ejection. The cap 25 may receive the liquid ejected from the liquid ejecting head 20 by an empty ejection. In the empty ejection of the present embodiment, the liquid ejecting head 20 located at the home position ejects the liquid toward the cap 25 located at the separation position.

Electrical Configuration

Figure 3:
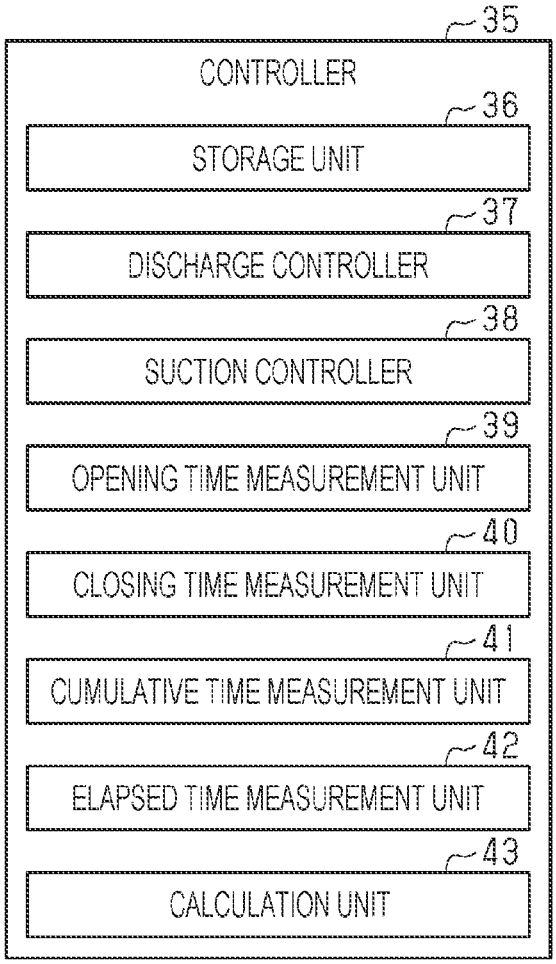
FIG. 3 is a block diagram of a controller.

As shown in FIG. 3, the liquid ejecting apparatus 11 includes a controller 35 that controls the liquid ejecting head 20. The controller 35 controls various units of the liquid ejecting apparatus 11 such as the maintenance unit 17.

The controller 35 can be configured as a circuit including a: one or a plurality of processors that executes various processes according to computer programs, β: one or a plurality of dedicated hardware circuits such as an integrated circuit, for a specific application, that executes at least part of the various processes, or y: a combination thereof. The processor includes a CPU and a memory such as a RAM and a ROM, and the memory stores a program code or an instruction configured to cause the CPU to execute a process. The memory, that is, a computer-readable medium, includes any readable medium that can be accessed by a general-purpose or dedicated computer.

The controller 35 includes a storage unit 36. The storage unit 36 is, for example, a memory such as the RAM and the ROM described above. The storage unit 36 stores various programs and various parameters. By executing the programs stored in the storage unit 36, the controller 35 may function as a discharge controller 37, a suction controller 38, an opening time measurement unit 39, a closing time measurement unit 40, a cumulative time measurement unit 41, an elapsed time measurement unit 42 and a calculation unit 43. Therefore, it can be said that the controller 35 includes the discharge controller 37, the suction controller 38, the opening time measurement unit 39, the closing time measurement unit 40, the cumulative time measurement unit 41, the elapsed time measurement unit 42, and the calculation unit 43.

The storage unit 36 may store a predetermined coefficient including the first coefficient and the second coefficient. The storage unit 36 may store a preset initial liquid amount. The storage unit 36 may store a preset initial available water amount. The initial liquid amount is the amount of liquid retained by the cap 25 with the initial filling of the liquid ejecting head 20 with the liquid for the first time. The initial available water amount is the amount of the available water contained in the liquid in the cap 25 after initial filling. In the initial filling, the suction mechanism 26 depressurizes the inside of the closed space 33 with the cap 25 capping the liquid ejecting head 20. The cap 25 receives the liquid discharged from the nozzle 19 during the initial filling.

The storage unit 36 may store the available water amount and the unavailable water amount contained in the liquid per unit amount as information about the liquid. The controller 35 may acquire information about the liquid from, for example, the liquid container 22 and store the acquired information in the storage unit 36.

The discharge controller 37 forcibly discharges the liquid from the nozzle 19 into the cap 25. The discharge controller 37 may forcibly discharge the liquid from the nozzle 19 into the cap 25 by performing an empty ejection in which the liquid is ejected from the liquid ejecting head 20. The discharge controller 37 may discharge the liquid by performing suction cleaning. More liquid can be discharges from the nozzle 19 by the suction cleaning than by the empty ejection.

The suction controller 38 causes the suction mechanism 26 to perform a suction operation. The suction mechanism 26 performs suction cleaning of the liquid ejecting head 20 by performing a suction operation. The suction controller 38 may control the drive of the suction mechanism 26 to select and perform a first suction operation and a second suction operation. In the first suction operation, suction cleaning is performed to suck a first suction amount of liquid from the nozzle 19. In the second suction operation, suction cleaning is performed to suck a second suction amount of liquid smaller than the first suction amount from the nozzle 19. The suction controller 38 may change the suction amount by changing the driving time of the discharge pump 29, for example.

The opening time measurement unit 39 measures the opening time during which the cap 25 is opened each time the cap 25 is opened. The opening time measurement unit 39 measures the opening time from the opening of the closed space 33 to the formation of the closed space 33 again to store the measured opening time in the storage unit 36.

The closing time measurement unit 40 measures the closing time during which the cap 25 is closed to form the closed space 33 each time the cap 25 is closed. The closing time measurement unit 40 measures the closing time from the formation of the closed space 33 to the opening of the closed space 33 to store the measured closing time in the storage unit 36.

The cumulative time measurement unit 41 measures the cumulative opening time, which is the cumulative amount of the opening time. The cumulative time measurement unit 41 may measure the cumulative opening time by stopping the time measurement while the closed space 33 is formed. The cumulative opening time may be obtained by the calculation unit 43 adding each opening time measured by the opening time measurement unit 39 to. In this case, the opening time measurement unit 39 and the calculation unit 43 also function as the cumulative time measurement unit 41.

The elapsed time measurement unit 42 measures the elapsed time that has elapsed since the immediately preceding ejection by the liquid ejecting head 20 was ended. The elapsed time measurement unit 42 may measure the elapsed time that has elapsed since printing was ended. The elapsed time measurement unit 42 may measure the elapsed time that has elapsed since the empty ejection was ended.

The calculation unit 43 may calculate the cumulative water permeation amount, which is a cumulative amount of water permeating from the inside of the cap 25 to the outside of the cap 25, based on the elapsed time. Water may permeate the cap 25. That is, the water in the cap 25 may decrease even when the cap 25 maintains capping. The calculation unit 43 may calculate the cumulative water permeation amount by multiplying, for example, the amount of water permeating through the cap 25 per unit time stored by the storage unit 36 by the elapsed time.

The calculation unit 43 calculates the available water amount. Assuming that the amount of water in the liquid is the water amount, the available water amount is expressed by the following formula.

$$\text{Available water amount} = \text{Water amount} - \text{Unavailable water amount} \quad (1)$$

That is, the available water amount is the amount obtained by subtracting the unavailable water amount, which is the water amount absorbed by the humectant, from the water amount in the liquid. The calculation unit 43 stores the calculated available water amount in the storage unit 36.

Liquid Amount in Cap

The calculation unit 43 may calculate the liquid amount in the cap, which is the amount of liquid in the cap 25, and store the calculated liquid amount in the storage unit 36.

The liquid amount in the cap after empty suction and after suction cleaning is almost equal to the initial liquid amount. The liquid amount in the cap after empty ejection is expressed by the following formula. The received amount is the amount of liquid discharged from the nozzle 19 with the empty ejection and received by the cap 25.

$$\text{Liquid amount in cap after empty ejection} = \text{Liquid amount in cap before empty ejection} + \text{Received amount} \quad (2)$$

The calculation unit 43 calculates the liquid amount in the cap after empty suction by adding the received amount to the liquid amount in the cap before empty ejection stored in the storage unit 36.

Available Water Amount in Cap after Empty Ejection

The calculation unit 43 calculates the available water amount in the cap, which is the available water amount of liquid in the cap 25, based on the amount of liquid discharged from the nozzle 19 into the cap 25.

The available water amount in the cap after empty ejection is expressed by the following formula. The received amount is the amount of liquid discharged from the nozzle 19 into the cap 25 and received by the cap 25.

$$\text{Available water amount in cap after empty ejection} = \text{Available water amount in cap before empty ejection} + \text{Received amount} \times \text{Available water coefficient} \quad (3)$$

The available water coefficient indicates the ratio of available water to the received amount. The storage unit 36 may store the available water coefficient in advance. The available water amount contained in the received amount of liquid can be calculated by multiplying the received amount by the available water coefficient. The calculation unit 43 may calculate the available water amount in the cap after empty ejection by adding the available water amount contained in the liquid discharged from the nozzle 19 to the available water amount in the cap before empty ejection.

Humectant Amount in Cap after Empty Ejection

The humectant amount in the cap, which is the amount of the humectant contained in the liquid in the cap 25, is expressed by the following formula. The received amount is the amount of liquid discharged from the nozzle 19 into the cap 25 and received by the cap 25.

$$\text{Humectant amount in cap after empty ejection} = \text{Humectant amount in cap before empty ejection} + \text{Received amount} \times \text{Humectant coefficient} \quad (4)$$

The humectant coefficient indicates the ratio of the humectant amount to the received amount. The storage unit 36 may store the humectant coefficient in advance. The humectant amount contained in the received amount of liquid can be calculated by multiplying the received amount by the humectant coefficient. The calculation unit 43 may calculate the humectant amount in the cap after empty ejection by adding the humectant amount contained in the liquid discharged from the nozzle 19 to the humectant amount in the cap before empty ejection.

Available Water Amount in Cap after Empty Suction

The available water amount in the cap after empty suction is expressed by the following formula.

$$\text{Available water amount in cap after empty suction} = \text{Available water amount in cap before}$$

empty suction×Liquid amount in cap after empty suction/Liquid amount in cap before empty suction (5)

In the empty suction, the liquid in the cap 25 is discharged from the cap 25, so that the ratio of the available water amount to the amount of liquid does not change. Therefore, the calculation unit 43 calculates the available water amount in the cap after empty suction by multiplying the available water amount in the cap before empty suction by the ratio of the liquid reduced by the empty suction.

Humectant Amount in Cap after Empty Suction

The humectant amount in the cap after empty suction is expressed by the following formula.

Humectant amount in cap after empty suction=Humectant amount in cap before empty suction×Liquid amount in cap after empty suction/Liquid amount in cap before empty suction (6)

In the empty suction, the liquid in the cap 25 is discharged from the cap 25, so that the ratio of the humectant amount to the amount of liquid does not change. Therefore, the calculation unit 43 calculates the humectant amount in the cap after empty suction by multiplying the humectant amount in the cap before empty suction by the ratio of the liquid reduced by the empty suction.

Available Water Amount in Cap after Suction Cleaning

When the suction mechanism 26 sucks the liquid from the nozzle 19, the calculation unit 43 may calculate the available water amount in the cap after suction based on a plurality of parameters including a liquid amount in the cap before suction, an available water amount in the cap before suction, a received amount, and an available received amount. The liquid amount in the cap before suction is the amount of liquid in the cap 25 before suction. The available water amount in the cap before suction is the available water amount contained in the liquid in the cap 25 before suction. The received amount is a difference between the amount of liquid discharged from the nozzle 19 with the suction and the amount of liquid discharged from the cap 25, and is the amount of liquid increased by suction cleaning. The available received amount is a difference between the available water amount contained in the liquid discharged from the nozzle 19 and the available water amount discharged from the cap 25. In other words, the available received amount is an available water amount contained in the received amount of liquid. The calculation unit 43 may calculate the available received amount by multiplying the received amount by the available water coefficient.

The available water amount in the cap after suction cleaning is expressed by the following formula.

Available water amount in cap=(Available water amount in cap+Available received amount)×Liquid amount in cap after suction cleaning/(Liquid amount in cap before suction cleaning+Received amount) (7)

Humectant Amount in Cap after Suction Cleaning

The humectant amount in the cap after suction cleaning is expressed by the following formula.

Humectant amount in cap=(Humectant amount in cap+Received humectant amount)×Liquid amount in cap after suction cleaning/(Liquid amount in cap before suction cleaning+Received amount) (8)

The received humectant amount is a humectant amount contained in the liquid discharged from the nozzle 19, and is the humectant amount contained in the received amount of liquid. The calculation unit 43 may calculate the received humectant amount by multiplying the received amount by the humectant coefficient.

The calculation unit 43 may calculate the available water amount in the cap based on the measurement result by the opening time measurement unit 39, the measurement result by the closing time measurement unit 40, and the measurement result by the cumulative time measurement unit 41. The calculation unit 43 may calculate the available water amount in the cap based on the calculated cumulative water permeation amount. For example, the calculation unit 43 may calculate the amount of evaporation using at least one of the parameters among the opening time measured by the opening time measurement unit 39, the closing time measured by the closing time measurement unit 40, the cumulative opening time measured by the cumulative time measurement unit 41, and the cumulative water permeation amount.

The storage unit 36 may store the amount of water that evaporates per unit time in a state where the closed space 33 is open. The calculation unit 43 may calculate the amount of evaporation in the open state by multiplying the amount of water that evaporates per unit time in the open state by the opening time or the cumulative opening time.

The storage unit 36 may store the amount of water that evaporates per unit time in a state where the closed space 33 is closed. The calculation unit 43 may calculate the amount of evaporation in the closed state by multiplying the amount of water that evaporates per unit time in the closed state by the closing time. The calculation unit 43 may calculate the amount of evaporation by adding the amount of evaporation or the cumulative water permeation amount in the closed state to the amount of evaporation in the open state.

The calculation unit 43 may use the amount of evaporation to calculate the liquid amount in the cap and the available water amount in the cap.

Liquid amount in cap=Liquid amount in cap−Amount of evaporation (9)

Available water amount in cap=Available water amount in cap−Amount of evaporation (10)

The calculation unit 43 may update the liquid amount in the cap stored by the storage unit 36 to an amount obtained by subtracting the amount of evaporation. The calculation unit 43 may update the available water amount in the cap stored by the storage unit 36 to an amount obtained by subtracting the amount of evaporation. The calculation unit 43 may periodically reflect the amount of evaporation in the liquid amount in the cap and the available water amount in the cap. The calculation unit 43 may reflect the amount of evaporation in the liquid amount in the cap and the available water amount in the cap at least one of the timings when the power of the liquid ejecting apparatus 11 is turned on and when the power is turned off. The humectant remains in the cap 25 without evaporating. Therefore, even when the liquid amount in the cap and the available water amount in the cap change due to evaporation of water, the humectant amount in the cap remains substantially the same.

Next, referring to the flowcharts shown in FIGS. 4 and 5, the maintenance method of the liquid ejecting apparatus 11 will be described. The controller 35 may periodically perform the maintenance routine shown in FIGS. 4 and 5, or may perform the maintenance routine at any timing such as before empty ejection, after empty ejection, before capping, after capping, before suction cleaning, after suction cleaning, before empty suction, after empty suction, or the like.

Figure 4:
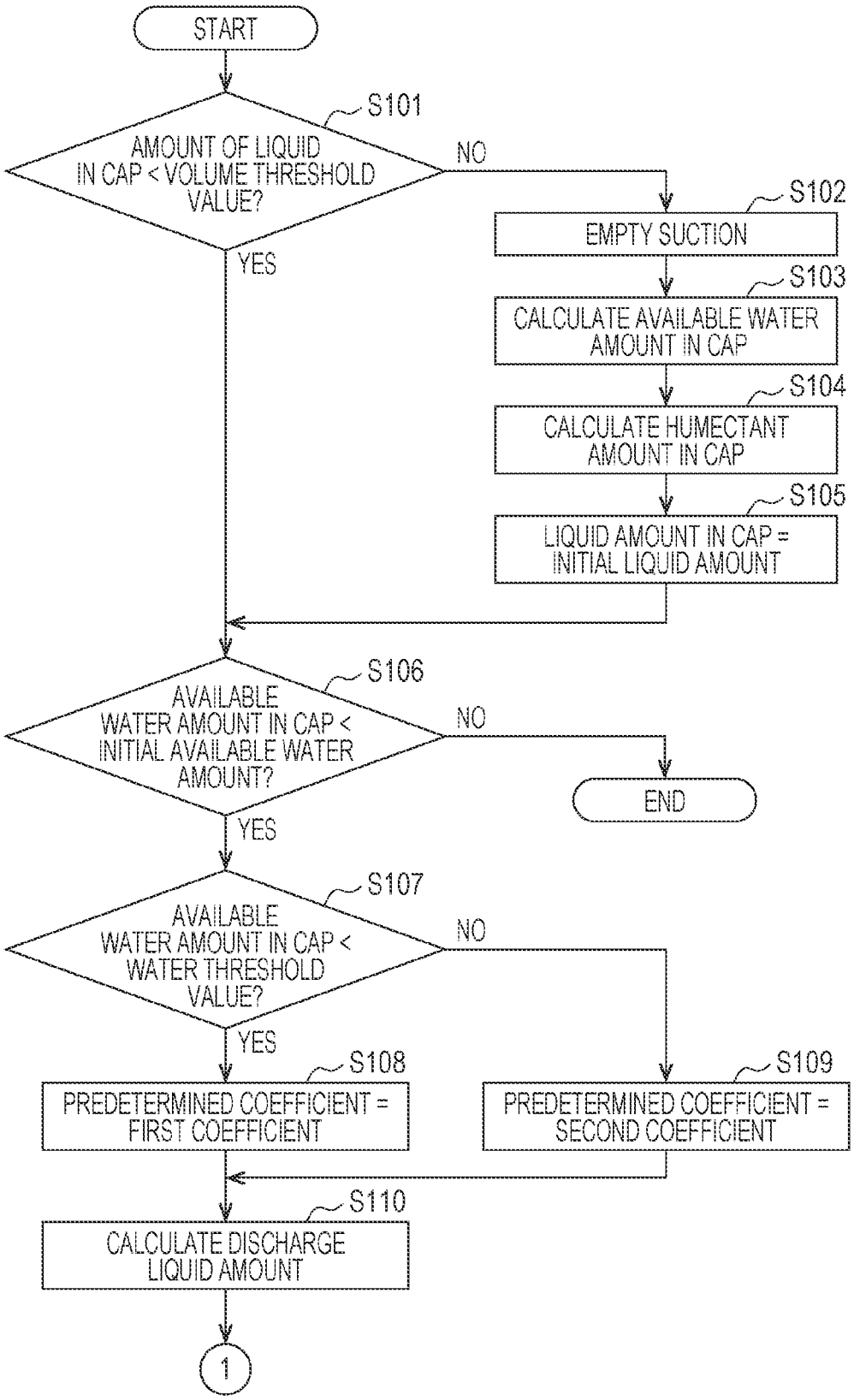
FIG. 4 is a flowchart showing a maintenance routine.

As shown in FIG. 4, in step S101 the controller 35 compares the liquid amount in the cap stored by the storage unit 36 with a capacity threshold value. The capacity threshold value may be the amount of liquid that the cap 25 can store or the amount of liquid that the absorbing member 32 can retain.

When the liquid amount in the cap is equal to or greater than the capacity threshold value, the result is determined to be NO in step S101, and the controller 35 advances the process to step S102. In step S102, the controller 35 performs an empty suction.

In step S103, the controller 35 calculates the available water amount in the cap, and updates the available water amount in the cap stored by the storage unit 36 to the calculated available water amount in the cap. In step S104, the controller 35 calculates the humectant amount in the cap, and updates the humectant amount in the cap stored by the storage unit 36 to the calculated humectant amount in the cap. In step S105, the controller 35 sets the liquid amount in the cap stored in the storage unit 36 as the initial liquid amount, and advances the process to step S106.

In step S101, when the liquid amount in the cap is less than the capacity threshold value, the result is determined to be YES in step S101, and the controller 35 advances the process to step S106. In step S106, the controller 35 compares the available water amount in the cap with the initial available water amount.

When the available water amount in the cap is equal to or greater than the initial available water amount, the result is determined to be NO in step S106, and the controller 35 ends the maintenance routine. When the available water amount in the cap is less than the initial available water amount, the result is determined to be YES in step S106, and the controller 35 advances the process to step S107.

In step S107, the controller 35 compares the available water amount in the cap with the water threshold value. The water threshold value is a value stored in advance by the storage unit 36. When the available water amount in the cap is less than the water threshold value, the result is determined to be YES in step S107, and the controller 35 advances the process to step S108. In step S108, the controller 35 sets a predetermined coefficient as the first coefficient.

When the available water amount in the cap is equal to or greater than the water threshold value, the result is determined to be NO in step S107, and the controller 35 advances the process to step S109. In step S109, the controller 35 sets a predetermined coefficient as the second coefficient. The second coefficient is smaller than the first coefficient. In step S110, the controller 35 calculates the discharge liquid amount.

Figure 5:
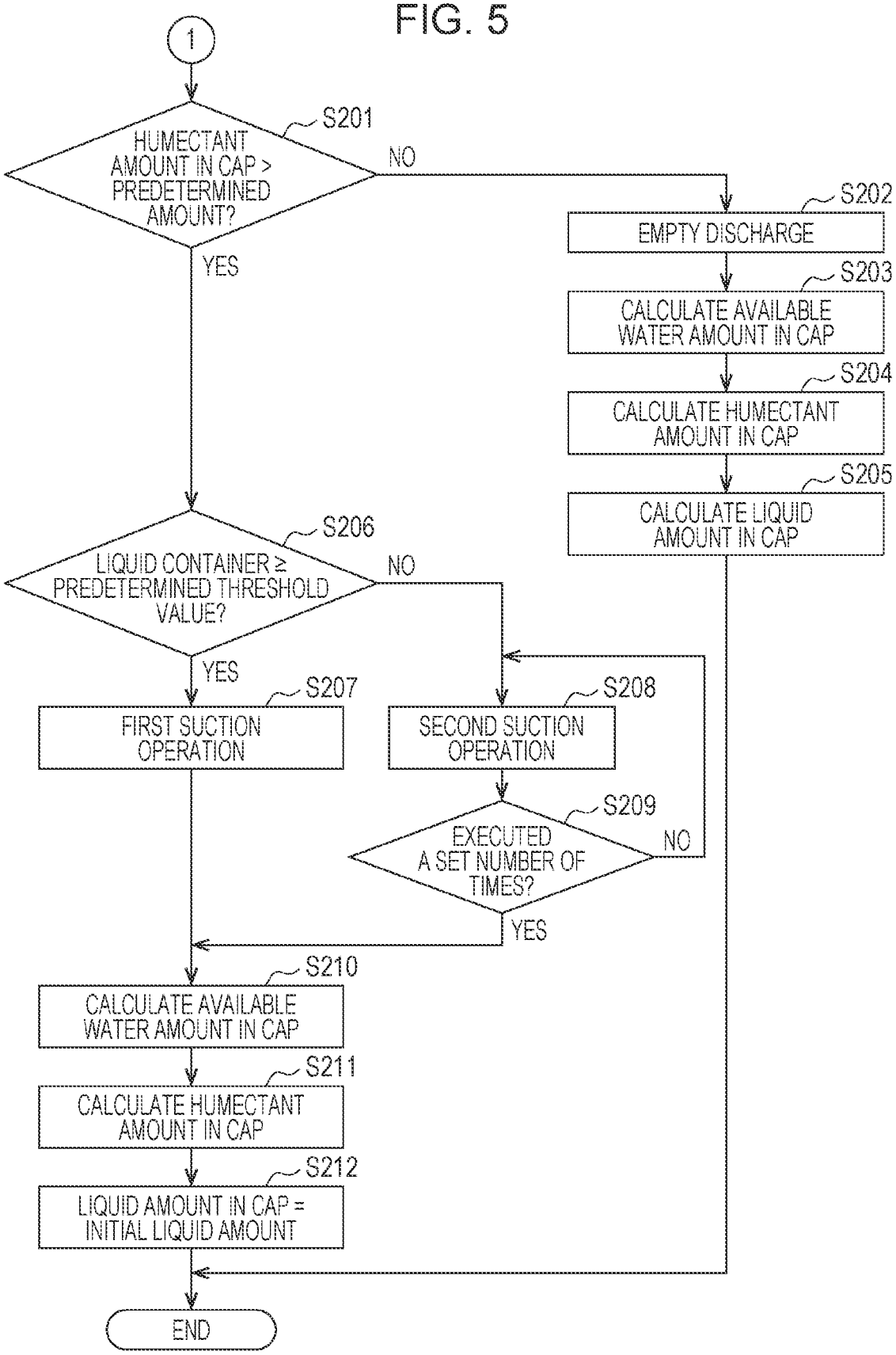
FIG. 5 is a flowchart showing a maintenance routine.

As shown in FIG. 5, in step S201, the controller 35 compares the humectant amount in the cap stored by the storage unit 36 with a predetermined amount. The storage unit 36 stores the predetermined amount in advance.

When the humectant amount in the cap is equal to or less than a predetermined amount, the result is determined to be NO in step S201, and the controller 35 advances the process to step S202. In step S202, the controller 35 performs an empty ejection, and ejects the discharge liquid amount of liquid from the nozzle 19 to the cap 25.

In step S203, the controller 35 calculates the available water amount in the cap, and updates the available water amount in the cap stored by the storage unit 36 to the calculated available water amount in the cap. In step S204, the controller 35 calculates the humectant amount in the cap, and updates the humectant amount in the cap stored by the storage unit 36 to the calculated humectant amount in the cap. In step S205, the controller 35 calculates the liquid amount in the cap, updates the liquid amount in the cap stored by the storage unit 36 to the calculated humectant amount in the cap, and ends the maintenance routine.

In step S201, when the humectant amount in the cap is larger than the predetermined amount, the result is determined to be YES in step S201, and the controller 35 advances the process to step S206. In step S206, the controller 35 compares the amount of liquid contained in the liquid container 22 with a predetermined threshold value. The storage unit 36 stores the predetermined threshold value in advance. The predetermined threshold value is larger than the first suction amount discharged with the first suction operation and the second suction amount discharged with the second suction operation.

When the amount of liquid contained in the liquid container 22 is equal to or greater than a predetermined threshold value, the result is determined to be YES in step S206, and the controller 35 advances the process to step S207. In step S207, the controller 35 performs the first suction operation.

When the amount of liquid contained in the liquid container 22 is less than the predetermined threshold value, the result is determined to be NO in step S206, and the controller 35 advances the process to step S208. In step S208, the controller 35 performs the second suction operation. In step S209, the controller 35 determines whether the second suction operation has been performed a set number of times. When the second suction operation has not been performed the set number of times, the result is determined to be NO in step S209, and the controller 35 advances the process to step S208. When the second suction operation is performed the set number of times, the result is determined to be YES in step S209, and the controller 35 advances the process to step S210. The set number of times is smaller than a quotient obtained by dividing the predetermined threshold value by the second suction amount. That is, the total amount of liquid discharged when the second suction operation is performed the set number of times is less than the predetermined threshold value.

In step S210, the controller 35 calculates the available water amount in the cap, and updates the available water amount in the cap stored by the storage unit 36 to the calculated available water amount in the cap. In step S211 the controller 35 calculates the humectant amount in the cap, and updates the humectant amount in the cap stored by the storage unit 36 to the calculated humectant amount in the cap. In step S212, the controller 35 sets the liquid amount in the cap stored by the storage unit 36 to an initial liquid amount, and ends the maintenance routine.

The operation of the embodiment will be described. When the available water amount in the cap is less than the preset initial available water amount, the discharge controller 37 forcibly discharges the discharge liquid amount of liquid from the nozzle 19 into the cap 25. The discharge controller 37 may discharge the liquid by empty ejection.

The calculation unit 43 calculates the discharge liquid amount based on the following formula.

$$\text{Discharge liquid amount} = (\text{Initial available water amount} - \text{Available water amount in cap}) \times \text{Predetermined coefficient} / \text{Available water coefficient} \quad (11)$$

The discharge liquid amount is the amount of liquid including, as the available water amount, an amount obtained by multiplying a difference between the available water amount in the cap and the initial available water amount by a predetermined coefficient larger than one. The available water amount is the amount obtained by subtracting the unavailable water amount absorbed by the humectant from the water amount in the liquid. Therefore, the available water amount contained in the discharge liquid amount of liquid is larger than the difference between the available water amount in the cap and the initial water amount.

Predetermined Coefficient

The predetermined coefficient may include the first coefficient and the second coefficient set according to an available water amount in the cap. The first coefficient set when the available water amount in the cap is small is larger than the second coefficient set when the available water amount in the cap is large. The predetermined coefficient may include three or more coefficients.

FIG. 6 shows the results of an experiment on the relationship between the amount of evaporation and the coefficient. The amount of evaporation is the difference between the initial available water amount and the available water amount in the cap. "Good" in FIG. 6 indicates that the available water amount in the cap is equal to or greater than the initial available water amount when the cap 25 receives the discharge liquid amount of liquid calculated using the coefficient. "Poor" in FIG. 6 indicates that the available water amount in the cap is less than the initial available water amount even when the cap 25 receives the discharge liquid amount of liquid calculated using the coefficient.

In the liquid, the water evaporates, while the humectant remains. Therefore, in the liquid in the cap 25, as the water evaporates, the concentration of the humectant increases and the ratio of the unavailable water amount increases. Therefore, when the predetermined coefficient=1, the available water amount in the cap cannot be equal to or greater than the initial available water amount.

In the embodiment, the predetermined coefficient is set to a value larger than 1. For example, the first coefficient may be set to 2.5 and the second coefficient may be set to 2, and the water threshold value for setting the predetermined coefficient may be set to initial available water amount−1 [g].

The controller 35 causes the suction mechanism 26 to perform the first suction operation when the humectant amount in the cap exceeds a predetermined amount, the amount of liquid contained in the liquid container 22 is equal to or more than a predetermined threshold value, and the first suction operation of sucking the first suction amount of liquid is required. The humectant amount in the cap is the amount of the humectant discharged into the cap 25. In the first suction operation, the first suction amount of liquid is sucked.

The controller 35 may cause the suction mechanism 26 to perform the second suction operation by a plurality of times when the humectant amount in the cap exceeds a predetermined amount, the amount of liquid contained in the liquid container 22 is less than the predetermined threshold value, and it is required to suck the first suction amount of liquid. The second suction operation sucks the second suction amount of liquid.

The effects of the embodiment will be described.

(1) The discharge controller 37 causes the cap 25 to discharge an amount of liquid including, as the available water amount, an amount obtained by multiplying the difference between the available water amount in the cap and the initial available water amount by a predetermined coefficient larger than one. Therefore, the cap 25 is supplied with an available amount of water that is larger than the difference between the available water amount in the cap and the initial available water amount. Therefore, compared with the case where the available water amount same as the difference between the available water amount in the cap and the initial available water amount is supplied, the amount of water taken by the humectant from the liquid in the nozzle 19 can be reduced, and it is possible to suppress an increase in viscosity of the liquid in the nozzle 19.

(2) As the available water amount in the cap decreases, the amount of liquid required to return to the initial available water amount increases. In this respect, the first coefficient set when the available water amount in the cap is small is larger than the second coefficient set when the available water amount in the cap is large. Therefore, the discharge controller 37 increases the amount of liquid discharged from the nozzle 19 when the available water amount in the cap is small, compared with when the available water amount in the cap is large. Therefore, even when the available water amount in the cap is reduced, it is possible to suppress an increase in viscosity of the liquid in the nozzle 19.

(3) The discharge controller 37 ejects the liquid from the liquid ejecting head 20. Therefore, the time required for discharging the liquid can be shortened, compared with the case where the liquid in the liquid ejecting head 20 is discharged by pressurizing or depressurizing.

(4) The calculation unit 43 calculates the available water amount in the cap after suction based on a plurality of parameters including the amount of liquid and the available water amount in the cap 25 before suction, and the amount of liquid and the available water amount discharged by the suction. Therefore, the available water amount in the cap can be calculated more accurately, compared with the case where the available water amount in the cap is calculated based on, for example, one parameter.

(5) When the amount of liquid contained in the liquid container 22 is less than a predetermined threshold value, the suction controller 38 causes the suction mechanism 26 to perform the second suction operation a plurality of times. Therefore, for example, the humectant can be easily flowed by the first time second suction operation, and the humectant in the easily flowable state can be discharged from the cap 25 by the second time suction operation. Therefore, the humectant amount in the cap 25 can be reduced while suppressing the consumption of the liquid.

(6) The ease of evaporation of the water contained in the liquid in the cap 25 varies depending on whether the cap 25 is open or closed. In this respect, the calculation unit 43 calculates the available water amount in the cap based on at least one opening time, at least one closing time, and the cumulative opening time. Therefore, the accuracy of calculating the available water amount in the cap can be improved.

(7) water contained in the liquid in the cap 25 may permeate the cap 25 and decrease even when the cap 25 is closed. In this respect, the calculation unit 43 calculates the available water amount in the cap based on the cumulative water permeation amount. Therefore, the accuracy of calculating the available water amount in the cap can be improved.

This embodiment can be modified and implemented as follows. The present embodiment and the following modifications can be implemented in combination with one another as long as there is no technical contradiction.

The controller 35 may periodically perform an empty ejection during printing.

The liquid ejecting apparatus 11 may include a pressurization mechanism that pressurizes the liquid in the liquid ejecting head 20 and a pressurization controller that controls the pressurization mechanism. The liquid ejecting apparatus 11 may perform pressure cleaning to discharge the pressurized liquid from the nozzle 19. In this case, the liquid ejecting apparatus 11 may not include the suction mechanism 26 and the suction controller 38. The pressurization controller performs a first pressurizing operation of discharging a first pressurization amount of liquid and a second pressurizing operation of discharging a second pressurization amount of liquid smaller than the first pressurizing amount.

The discharge controller 37 may discharge the discharge liquid amount of liquid from the liquid ejecting head 20 by pressure cleaning.

The discharge controller 37 may discharge the discharge liquid amount of liquid from the liquid ejecting head 20 by suction cleaning.

The predetermined coefficient may be one preset coefficient.

A predetermined coefficient may be set according to the amount of evaporation. For example, the predetermined coefficient may be set to the first coefficient when the amount of evaporation is large, and may be set to the second coefficient when the amount of western hair is small.

The predetermined coefficient may be set according to the ratio of the available water amount in the cap to the liquid amount in the cap. For example, the predetermined coefficient may set to the first coefficient when the ratio of the available water amount in the cap to the liquid amount in the cap is small, and may be set to the second coefficient when the ratio of the available water amount in the cap to the liquid amount in the cap is large.

The discharge controller 37 may select and perform the first suction operation and the second suction operation based on the amount of liquid that can be stored in the waste liquid storage unit 27. For example, when the additional storage capacity, which is the amount of liquid that can be additionally stored in the waste liquid storage unit 27, is larger than the first suction amount, the discharge controller 37 may perform the first suction operation. When the additional storage capacity is smaller than the first suction amount, the discharge controller 37 may perform the second suction operation a plurality of times.

The liquid container 22 may be a replaceable cartridge or a tank that can be refilled with liquid. The liquid container 22 may be provided at a position different from that of the carriage 21. The liquid ejecting head 20 may eject the liquid supplied from the liquid container 22 via the liquid supply flow path.

The liquid ejecting apparatus 11 may be a liquid ejecting apparatus that jets or ejects a liquid other than ink. The state of the liquid ejected from the liquid ejecting apparatus in the form of a minute amount of droplets includes particles, teardrops, and filamentous tails. The liquid here may be any material that can be ejected from the liquid ejecting apparatus. For example, the liquid may be a substance in a state when the substance is in the liquid phase, and includes fluid materials such as liquids having high or low viscosity, sol, gel water, other inorganic solvents, organic solvents, solutions, liquid resins, liquid metals, metal melts. Further, the liquid includes not only a liquid as a state of a substance but also a liquid in which particles of a functional material made of a solid such as a pigment or metal particles are dissolved, dispersed or mixed in a solvent. Representative examples of the liquid include ink and liquid crystal as described in the above embodiment. Here, the ink includes various liquid compositions such as general water-based ink and oil-based ink, gel ink, and hot-melt ink. Specific examples of the liquid ejecting apparatus includes an apparatus that ejects a liquid containing a material such as an electrode material or a coloring material used for manufacturing a liquid crystal display, an electroluminescence display, a surface emitting display, a color filter or the like in a dispersed or dissolved form. The liquid ejecting apparatus may be a device that ejects a bio-organic substance used in biochip manufacturing, a device that ejects a liquid serving as a sample used as a precision pipette, printing equipment, a micro dispenser, or the like. The liquid ejecting apparatus may be an apparatus that ejects lubricating oil to a precision machine such as a watch or a camera at a pinpoint or an apparatus that ejects a transparent resin liquid such as an ultraviolet curable resin onto the substrate in order to form a micro hemispherical lens used for an optical communication element, an optical lens, or the like. The liquid ejecting apparatus may be an apparatus that ejects an etching liquid such as acid or alkali for etching the substrate and the like.

In the following, technical ideas and their functions and effects which are grasped from the above-described embodiments and modifications will be described.

(A) A liquid ejecting apparatus includes a liquid ejecting head that ejects a liquid containing a humectant and water from a nozzle, a cap configured to form a closed space to which the nozzle opens, and a controller that controls the liquid ejecting head, wherein the controller includes a calculation unit that calculates an available water amount obtained by subtracting a water amount absorbed by the humectant from a water amount in the liquid, and a discharge controller that forcibly discharges the liquid from the nozzle into the cap, wherein the calculation unit calculates an available water amount in the cap, which is the available water amount of the liquid in the cap, based on an amount of the liquid discharged from the nozzle into the cap, and wherein when an available water amount in the cap is smaller than a preset initial available water amount, the discharge controller discharges an amount of the liquid, where the amount includes, as the available water amount, an amount obtained by multiplying a difference between an available water amount in the cap and the initial available water amount by a predetermined coefficient larger than one.

According to this configuration, the discharge controller causes the cap to discharge an amount of liquid including, as the available water amount, an amount obtained by multiplying the difference between the available water amount in the cap and the initial available water amount by a predetermined coefficient larger than one. Therefore, the cap is supplied with an available amount of water that is larger than the difference between the available water amount in the cap and the initial available water amount. Therefore, compared with the case where the same amount of active water as the difference between the available water amount in the cap and the initial available water amount is supplied, the amount of water taken by the humectant from the liquid in the nozzle can be reduced, and it is possible to suppress an increase in viscosity of the liquid in the nozzle.

(B) In the liquid ejecting apparatus, the predetermined coefficient may include a first coefficient and a second coefficient set according to an available water amount in the cap, and wherein the first coefficient set when the available water amount in the cap is small may be larger than the second coefficient set when the available water amount in the cap is large.

As the available water amount in the cap decreases, the amount of liquid required to return to the initial available water amount increases. In this respect, according to this configuration, the first coefficient set when the available water amount in the cap is small is larger than the second coefficient set when the available water amount in the cap is large. Therefore, the discharge controller increases the amount of liquid discharged from the nozzle when the available water amount in the cap is small, compared with when the available water amount in the cap is large. Therefore, even when the available water amount in the cap is reduced, it is possible to suppress an increase in viscosity of the liquid in the nozzle.

(C) In the liquid ejecting apparatus, the discharge controller forcibly may eject the liquid from the nozzle into the cap by ejecting the liquid from the liquid ejecting head.

According to this configuration, the discharge controller ejects the liquid from the liquid ejecting head. Therefore, the time required for discharging the liquid can be shortened, compared with the case where the liquid in the liquid ejecting head is discharged by pressurizing or depressurizing.

(D) The liquid ejecting apparatus may further include a suction mechanism that sucks the liquid from the nozzle through the closed space, and wherein when the suction mechanism sucks the liquid from the nozzle, the calculation unit may calculate an available water amount in the cap after suction based on a plurality of parameters including an amount of the liquid in the cap before suction, the available water amount contained in the liquid in the cap before suction, an amount of the liquid discharged from the nozzle with suction, and the available water amount contained in the liquid discharged from the nozzle.

According to this configuration, the calculation unit calculates the available water amount in the cap after suction based on a plurality of parameters including the amount of liquid and the available water amount in the cap before suction, and the amount of liquid and the available water amount discharged by the suction. Therefore, the available water amount in the cap can be calculated more accurately, compared with the case where the available water amount in the cap is calculated based on, for example, one parameter.

(E) In the liquid ejecting apparatus, the liquid ejecting head may eject the liquid contained in a liquid container, wherein the controller further may include a suction controller that causes the suction mechanism to perform a suction operation, and wherein when a humectant amount, which is an amount of the humectant discharged into the cap, exceeds a predetermined amount, an amount of the liquid contained in the liquid container is equal to or more than a predetermined threshold value, and a first suction operation of sucking a first suction amount of liquid is required, the suction controller may cause the suction mechanism to perform the first suction operation, and when the humectant amount exceeds the predetermined amount, the amount of the liquid contained in the liquid container is less than the predetermined threshold value, and it is required to suck the first suction amount of liquid, the suction controller may cause the suction mechanism to perform a second suction operation of sucking a second suction amount of liquid smaller than the first suction amount of liquid a plurality of times.

According to this configuration, when the amount of liquid contained in the liquid container is less than a predetermined threshold value, the suction controller causes the suction mechanism to perform the second suction operation a plurality of times. Therefore, for example, the humectant can be easily flowed by the first time second suction operation, and the humectant in the easily flowable state can be discharged from the cap by the second time suction operation. Therefore, the humectant amount in the cap can be reduced while suppressing the consumption of the liquid.

(F) In the liquid ejecting apparatus, the controller may further include an opening time measurement unit that measures an opening time during which the cap is opened each time the cap is opened, a closing time measurement unit that measures a closing time during which the cap is closed to form the closed space each time the cap is closed, and a cumulative time measurement unit that measures a cumulative opening time, which is a cumulative amount of the opening time, and wherein the calculation unit may calculate an available water amount in the cap based on a measurement result by the opening time measurement unit, a measurement result by the closing time measurement unit, and a measurement result by the cumulative time measurement unit.

According to this configuration, the ease of evaporation of the water contained in the liquid in the cap varies depending on whether the cap is open or closed. In this respect, according to this configuration, the calculation unit calculates the available water amount in the cap based on at least one opening time, at least one closing time, and the cumulative opening time. Therefore, the accuracy of calculating the available water amount in the cap can be improved.

(G) In the liquid ejecting apparatus, the controller may further include an elapsed time measurement unit that measures an elapsed time that elapses since an immediately preceding ejection by the liquid ejecting head was ended, and wherein the calculation unit may calculate, based on the elapsed time, a cumulative water permeation amount, which is a cumulative amount of water permeating from an inside of the cap to an outside of the cap, to calculate an available water amount in the cap based on the calculated cumulative water permeation amount.

Water contained in the liquid in the cap may permeate the cap and decrease even when the cap is closed. In this respect, according to this configuration, the calculation unit calculates the available water amount in the cap based on the cumulative water permeation amount. Therefore, the accuracy of calculating the available water amount in the cap can be improved.

(H) A method of maintaining a liquid ejecting apparatus includes a liquid ejecting head that ejects a liquid containing a humectant and water from a nozzle, and a cap configured to form a closed space to which the nozzle opens, and the method includes calculating an available water amount in the cap obtained by subtracting a water amount absorbed by the humectant from a water amount in the liquid in the cap based on an amount of the liquid discharged from the nozzle into the cap, and when the available water amount in the cap is smaller than a preset initial available water amount, forcibly discharging, from the nozzle into the cap, an amount of the liquid, where the amount includes, as an available water amount obtained by subtracting an amount of water absorbed by the humectant from a water amount in the liquid, an amount obtained by multiplying a difference between the available water amount in the cap and the initial available water amount by a predetermined coefficient larger than one.

According to this method, the same effect as that of the liquid ejecting apparatus can be obtained.

What is claimed is:

1. A liquid ejecting apparatus comprising:

a liquid ejecting head that ejects a liquid containing a humectant and water from a nozzle;

a cap configured to form a closed space to which the nozzle opens; and a controller that controls the liquid ejecting head, wherein the controller includes:

a calculation unit that calculates an available water amount obtained by subtracting a water amount absorbed by the humectant from a water amount in the liquid, and a discharge controller that forcibly discharges the liquid from the nozzle into the cap, wherein the calculation unit calculates an available water amount in the cap, which is the available water amount of the liquid in the cap, based on an amount of the liquid discharged from the nozzle into the cap, wherein when the available water amount in the cap is smaller than a preset initial available water amount, the discharge controller discharges an amount of the liquid, the amount including, as the available water amount, an amount obtained by multiplying a difference between the available water amount in the cap and the initial available water amount by a predetermined coefficient larger than one, wherein the predetermined coefficient includes a first coefficient and a second coefficient that are set according to the available water amount in the cap, wherein the first coefficient is set when the available water amount in the cap is less than a threshold amount, wherein the second coefficient is set when the available water amount in the cap is larger than the threshold amount, and wherein the first coefficient is larger than the second coefficient.

2. The liquid ejecting apparatus according to claim 1, wherein the discharge controller forcibly ejects the liquid from the nozzle into the cap by ejecting the liquid from the liquid ejecting head.

3. The liquid ejecting apparatus according to claim 1, further comprising:

a suction mechanism that sucks the liquid from the nozzle through the closed space, wherein when the suction mechanism sucks the liquid from the nozzle, the calculation unit calculates an available water amount in the cap after suction based on a plurality of parameters including an amount of the liquid in the cap before suction, the available water amount contained in the liquid in the cap before suction, an amount of the liquid discharged from the nozzle with suction, and the available water amount contained in the liquid discharged from the nozzle.

4. The liquid ejecting apparatus according to claim 3, wherein the liquid ejecting head ejects the liquid contained in a liquid container, wherein the controller further includes a suction controller that causes the suction mechanism to perform a suction operation, wherein when a humectant amount, which is an amount of the humectant discharged into the cap, exceeds a predetermined amount, an amount of the liquid contained in the liquid container is equal to or more than a predetermined threshold value, and a first suction operation of sucking a first suction amount of liquid is required, the suction controller causes the suction mechanism to perform the first suction operation, and wherein when the humectant amount exceeds the predetermined amount, the amount of the liquid contained in the liquid container is less than the predetermined threshold value, and it is required to suck the first suction amount of liquid, the suction controller causes the suction mechanism to perform a second suction operation of sucking a second suction amount of liquid smaller than the first suction amount of liquid a plurality of times.

5. The liquid ejecting apparatus according to claim 1, wherein the controller further includes:

an opening time measurement unit that measures an opening time during which the cap is opened each time the cap is opened, a closing time measurement unit that measures a closing time during which the cap is closed to form the closed space each time the cap is closed, and a cumulative time measurement unit that measures a cumulative opening time, which is a cumulative amount of the opening time, wherein the calculation unit calculates an available water amount in the cap based on a measurement result by the opening time measurement unit, a measurement result by the closing time measurement unit, and a measurement result by the cumulative time measurement unit.

6. A liquid ejecting apparatus comprising:

a liquid ejecting head that ejects a liquid containing a humectant and water from a nozzle;

a cap configured to form a closed space to which the nozzle opens; and a controller that controls the liquid ejecting head, wherein the controller includes:

a calculation unit that calculates an available water amount obtained by subtracting a water amount absorbed by the humectant from a water amount in the liquid, and a discharge controller that forcibly discharges the liquid from the nozzle into the cap, and an elapsed time measurement unit that measures an elapsed time that elapses since an immediately preceding ejection by the liquid ejecting head was ended, wherein the calculation unit calculates, based on the elapsed time, a cumulative water permeation amount, which is a cumulative amount of water permeating from an inside of the cap to an outside of the cap, wherein the calculation unit calculates an available water amount in the cap, which is the available water amount of the liquid in the cap, based on an amount of the liquid discharged from the nozzle into the cap and based on the calculated cumulative water permeation amount, and wherein when the available water amount in the cap is smaller than a preset initial available water amount, the discharge controller discharges an amount of the liquid, the amount including, as the available water amount, an amount obtained by multiplying a difference between the available water amount in the cap and the initial available water amount by a predetermined coefficient larger than one.

7. A method of maintaining a liquid ejecting apparatus including a liquid ejecting head that ejects a liquid containing a humectant and water from a nozzle, and a cap configured to form a closed space to which the nozzle opens, the method comprising:

calculating an available water amount in the cap obtained by subtracting a water amount absorbed by the humectant from a water amount in the liquid in the cap based on an amount of the liquid discharged from the nozzle into the cap; and when the available water amount in the cap is smaller than a preset initial available water amount, forcibly discharging, from the nozzle into the cap, the liquid of an amount, the amount including, as an available water amount obtained by subtracting an amount of water absorbed by the humectant from a water amount in the liquid, an amount obtained by multiplying a difference between the available water amount in the cap and the initial available water amount by a predetermined coefficient larger than one, wherein the predetermined coefficient includes a first coefficient and a second coefficient that are set according to the available water amount in the cap, wherein the first coefficient is set when the available water amount in the cap is less than a threshold amount, wherein the second coefficient set when the available water amount in the cap is larger than the threshold amount, and wherein the first coefficient is larger than the second coefficient.

* * * * *